US005841221A

United States Patent [19]

Griggs

[11] Patent Number: 5,841,221

[45] Date of Patent: Nov. 24, 1998

[54] COLLECTOR FOR AN ELECTRON BEAM TUBE

[75] Inventor: Alan Griggs, Heybridge, United Kingdom

[73] Assignee: EEV Limited, Chelmsford, United Kingdom

[21] Appl. No.: 835,427

[22] Filed: Apr. 9, 1997

[30] Foreign Application Priority Data

Apr. 20, 1996 [GB] United Kingdom ..... 9608250

[51] Int. Cl.[6] ..... H01J 23/02

[52] U.S. Cl. ..... 313/326; 313/308; 313/632; 313/311; 315/5.38

[58] Field of Search ..... 313/326, 308, 313/632, 30, 45, 46, 311; 315/5.38, 3.5

[56] References Cited

U.S. PATENT DOCUMENTS

| | | | |
|---|---|---|---|
| 3,549,930 | 12/1970 | Katz | 313/311 |
| 3,823,772 | 7/1974 | Lavering et al. | 315/5.38 X |
| 3,993,925 | 11/1976 | Achter et al. | 315/5.38 |
| 4,403,167 | 9/1983 | Maitland et al. | 313/634 |
| 4,504,762 | 3/1985 | Hart et al. | 313/46 X |
| 5,177,394 | 1/1993 | Kubo | 315/5.38 |
| 5,436,525 | 7/1995 | Theiss | 315/5.38 |

FOREIGN PATENT DOCUMENTS

| | | |
|---|---|---|
| 1300689 | 7/1970 | United Kingdom . |
| 1588766 | 10/1976 | United Kingdom . |

*Primary Examiner*—Ashok Patel
*Attorney, Agent, or Firm*—Donald C. Casey, Esq.

[57] ABSTRACT

A collector for an electron beam tube includes a ceramic cylinder within which are located rings of a first material, such as copper, and rings of a second material, such as molybdenum, arranged alternately along the longitudinal axis of the cylinder. The ratio of the axial lengths of the rings at the inner surface of the ceramic cylinder is selected so as to provide temperature compensation. The rings of one material surround part of adjacent rings of the other material to confine thermal expansion in a radial direction.

26 Claims, 1 Drawing Sheet

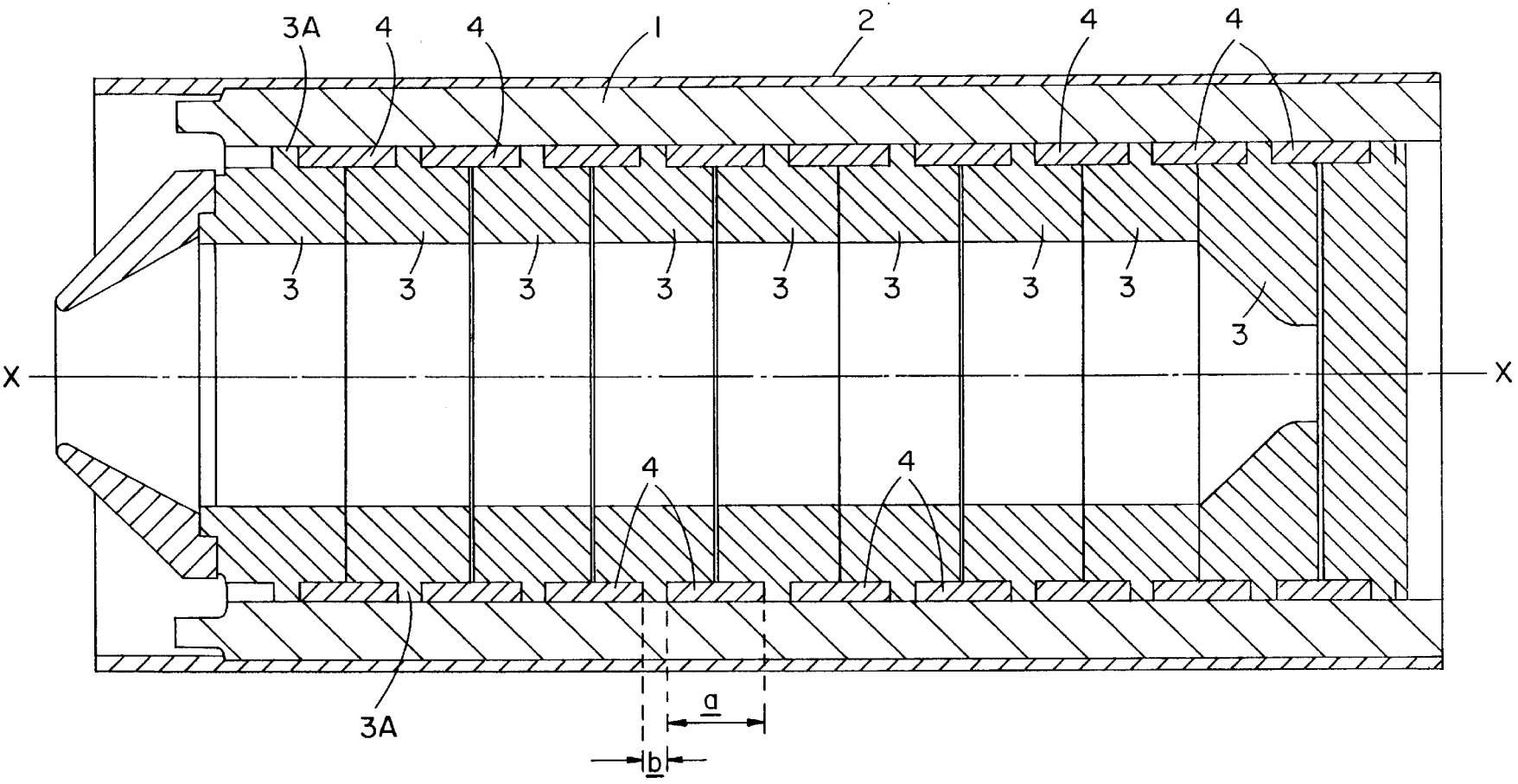
X
4
4
2
1
4
4
3A
3
3
3
3
3
3
3
3
3
4
4
a
b
3A
X

COLLECTOR FOR AN ELECTRON BEAM TUBE

FIELD OF THE INVENTION

This invention relates to a collector for an electron beam tube.

BACKGROUND OF THE INVENTION

Electron beam tubes, such as travelling wave tubes with coupled cavity or helix slow wave structures and klystrons, typically employ a collector arranged to receive the electron beam after it has been transmitted through the device. The collector includes a collector electrode which presents surfaces on which electrons of the beam are incident, giving up their kinetic energy in form of heat. The collector electrode is of a high thermal conductivity metal, usually copper. Cooling is required to remove heat from the collector, for example, by causing coolant fluid to flow over its outer surface. It is often desirable to operate the collector at a high voltage with respect to ground to give good efficiency. However if a low resistivity fluid is used to cool the collector it may lead to excessive current leakage. To prevent this leakage, the high voltage of the collector must be isolated from the coolant fluid. One method by which this may be achieved is to surround the collector electrode by a ceramic insulator, typically beryllia, through which heat generated by the spent electron beam is conducted. It is difficult to achieve an intimate contact between the metal and the ceramic, which is necessary to ensure sufficient heat is removed from the interior of the collector, because of the large difference in linear expansion coefficient between the metal of the collector electrode and the surrounding ceramic insulator. This may lead to catastrophic failure during assembly of the collector and/or its use.

Previously there have been various proposals to overcome this problem but these tend to be unsatisfactory as some require complicated constructions which are therefore expensive and difficult to fabricate, and others introduce power limitations.

The present invention seeks to provide a collector having a ceramic insulator in which the above problem is reduced or eliminated.

SUMMARY OF THE INVENTION

According to a first aspect of the invention there is provided a collector for an electron beam tube comprising: a ceramic cylinder having a longitudinal axis, and a plurality of rings of a first material and of rings of a second material different from the first located adjacent one another and adjacent the inner surface of the cylinder coaxial with the axis, the rings being located such that regions of the first material alternate with regions of the second material along the axis, the ratio of axial lengths of adjacent regions at the inner surface being such that the overall change in axial length of the plurality with temperature variation is substantially that of the ceramic cylinder.

Employing the invention enables temperature compensation to be achieved in an axial direction. The ratio of the lengths of the regions is selected such that the overall axial expansion of the combination of rings considered together is substantially the same as that of the ceramic material forming the cylinder. Local expansion mismatches along the axis between the rings and the cylinder are small as the length of each region is small compared to the overall axial length. The ratio of adjacent regions is chosen to be approximately the same along the length of the collector in most embodiments to achieve optimum characteristics.

The rings are not necessarily of identical configuration. They may be regular cylinders or of some other configuration, such as conical for example, or present a more complicated surface on which electrons are incident during use.

Preferably, both the first and second materials are metal or metallic alloys, giving good thermal conduction from the interior of the collector. In a particularly advantageous embodiment of the invention the first material is copper or includes copper and again advantageously the second material is molybdenum or includes molybdenum. It has been found that the combination of copper and molybdenum rings is particularly advantageous as this arrangement provides provides good electrical and thermal properties. When the first material is copper and the second material is molybdenum, preferably, the ratio of the axial lengths of the copper to molybdenum is approximately 1:4. This is particularly advantageous where the ceramic is beryllia as it gives good matching of thermal expansion characteristics. However, other ceramic materials, such as alumina, may be suitable.

The coefficients of linear expansion for copper, molybdenum and beryllia are approximately $16\times10^{-6}$, $5.5\times10^{-6}$ and $7.6\times10^{-6}K^{-1}$, respectively. Thus where, in a given unit axial length, a region of copper occupies 0.2 unit and molybdenum occupies 0.8 unit, the total expansion of the copper and molybdenum taken together is $7.7\times10^{-6}$, corresponding closely to that of the surrounding beryllia. The actual coefficients are dependent on the particular materials employed and their purity. The ratio of lengths may be precisely selected to give the required overall expansion.

It is preferred that a collector in accordance with the invention incorporates only rings of a first material and rings of a second material but in other embodiments, rings of other materials may also be included to give a particular ratio of axial lengths or provide radial constraint, for example. However, this introduces additional complexity and does not necessarily lead to an improvement in the performance of the construction.

Advantageously, the rings are arranged such that rings of the first material are arranged alternately with rings of the second material along the axis. Other arrangements are possible, for example, two rings of the second material may be positioned between each pair of rings of the first material, providing that the ratio of the axial lengths of the materials is correct.

In a preferred embodiment of the invention, at least some of the rings of the first material are configured such that their axial lengths at their outer surfaces are shorter than at their inner surfaces. This allows the correct ratio of axial lengths at the inner surface of the ceramic cylinder to be maintained whilst giving freedom to the designer to arrange that the surfaces on which electrons impact are wholly or mainly of the first material. Preferably at least some of the rings referred to each comprises a cylinder having an axially central portion with a larger outer diameter than its end portions. Alternatively, the rings could comprise cylinders having a larger outer diameter at one of their ends.

It may be preferred that rings of the second material located between the rings of the first material having longer inner surfaces are arranged coaxially outside parts of the rings of the first material. Where copper is the first material and molybdenum is the second material, therefore, the molybdenum rings will act to restrain radial expansion of the copper, molybdenum being a high strength material.

Advantageously, the rings are brazed together and it is further preferred that the rings are brazed to the ceramic cylinder. In an arrangement in accordance with the invention it is possible to achieve an intimate fit between the rings and the cylinder without a tendency for differential expansion to cause cracks.

The ceramic cylinder is usually of a circular cross-section and of a uniform thickness along its length but other configurations may also be employed in a collector in accordance with the invention. The cylinder is also generally of a unitary nature but in some constructions there may be several shorter cylinders joined together, for example. However, constructions of this type tend to be more complicated to fabricate, less robust and may not provide such good electrical isolation or thermal conductivity.

According to a second aspect of the invention, there is provided a collector for an electron beam tube comprising: a ceramic cylinder having a longitudinal axis, and a plurality of rings of a first material and rings of a second material different from the first located adjacent one another and adjacent the inner surface of the cylinder coaxial with the axis, the rings being located such that regions of the first material alternate with regions of the second material along the axis, and wherein rings of the second material coaxially surround part of adjacent rings of the first material. Thus the rings of the second material constrain radial expansion of those of the first material and protect the surrounding ceramic from stresses.

BRIEF DESCRIPTION OF THE DRAWING

One way in which the invention may be performed is now described by way of example with reference to the sole FIGURE which schematically illustrates in longitudinal cross-section a collector in accordance with the invention.

DESCRIPTION OF A PREFERRED EMBODIMENT

With reference to the FIGURE, a collector for a travelling wave tube comprises a beryllia ceramic cylinder 1 of circular transverse cross-section having a longitudinal axis X—X in the direction of the electron beam and being surrounded by a metal outer tube 2. A plurality of copper rings 3 and molybdenum rings 4 are arranged alternately along the axis X—X within the ceramic cylinder 1. The copper rings 3 have a relatively thick wall and an axially central part of larger outer diameter 3A which is adjacent to the inner surface of the ceramic cylinder 1. The molybdenum rings 4 have an outer surface which is adjacent the inner surface of the ceramic ring 1 and have thinner walls than the copper rings 3. The axial lengths (a) of the molybdenum rings at the inner surface of the ceramic cylinder 1 are approximately four times longer than the lengths (b) of the copper rings 3 at the inner surface of the ceramic cylinder 1. The copper and molybdenum rings 3 and 4 and the ceramic cylinder 1 are brazed together using solder shims located between the rings 3 and 4. The configuration of the copper rings 3 shields the molybdenum rings from impact by electrons. The molybdenum rings 4 located outside parts of the copper rings 3 restrain the radial expansion of copper.

During operation of the collector, the collector electrode defined by the copper rings 3 and molybdenum rings 4 is at a relatively high potential and the outer metal tube 2 is at ground.

I claim:

1. A collector for an electron beam tube comprising: a ceramic cylinder having an inner surface and a longitudinal axis, and a plurality of rings of a first material and of rings of a second material different from said first material located adjacent one another and adjacent said inner surface of said cylinder coaxial with said axis, said rings being located such that regions of said first material alternate with regions of said second material along said axis, the ratio of axial lengths of adjacent regions of said first and second material at said inner surface being such that the overall change in axial length of said plurality with temperature variation is substantially that of the change in axial length of said ceramic cylinder.

2. A collector as claimed in claim 1 wherein at least some of said rings of said first material are configured such that each has an outer circumferential surface and an inner circumferential surface and each has an axial length at its outer circumferential surface which is shorter than that at its inner circumferential surface.

3. A collector as claimed in claim 2 wherein at least some of said rings each comprises a cylinder having a portion at the centre of its axial length with a larger outer diameter than portions at its ends.

4. A collector as claimed in claim 2 wherein rings of said second material located between said at least some of said rings of said first material are also located coaxially outside parts of them.

5. A collector as claimed in claim 4 wherein said first material is or includes copper and said second material is or includes molybdenum.

6. A collector as claimed in claim 1 wherein said first and said second material are metal or a metallic alloy.

7. A collector as claimed in claim 1 wherein said first material is or includes copper.

8. A collector as claimed in claim 7 wherein said second material is or includes molybdenum.

9. A collector as claimed in claim 1 wherein said second material is or includes molybdenum.

10. A collector as claimed in claim 1 wherein said first material is copper and said second material is molybdenum, the ratio of the axial lengths of adjacent regions at said inner surface being approximately 1:4 of copper to molybdenum.

11. A collector as claimed in claim 1 wherein said ceramic cylinder is of beryllia.

12. A collector as claimed in claim 1 wherein rings of said first material are arranged alternately with rings of said second material along said axis.

13. A collector as claimed in claim 1 wherein adjacent rings are brazed together.

14. A collector as claimed in claim 1 wherein rings are brazed to said ceramic cylinder.

15. A collector as claimed in claim 1 and including an outer metal tube arranged coaxially outside and adjacent to said ceramic cylinder.

16. A collector for an electron beam tube comprising: a ceramic cylinder having an inner surface and a longitudinal axis, and a plurality of rings of a first material and rings of a second material different from said first material located adjacent one another and adjacent said inner surface of said cylinder coaxial with said axis, said rings being located such that regions of said first material alternate with regions of said second material along said axis, and wherein rings of said second material coaxially surround parts of adjacent rings of said first material.

17. A collector as claimed in claim 16 wherein rings of said first material each have an inner circumferential surface and an outer circumferential surface and each has a longer axial length at its inner circumferential surface than that at its outer circumferential surface.

18. A collector as claimed in claim 16 wherein said first and said second material are metal or a metallic alloy.

19. A collector as claimed in claim 16 wherein said first material is or includes copper.

20. A collector as claimed in claim 16 wherein said second material is or includes molybdenum.

21. A collector as claimed in claim 16 wherein said first material is copper and said second material is molybdenum, the ratio of the axial lengths of adjacent regions at said inner surface being approximately 1:4 of copper to molybdenum.

22. A collector as claimed in claim 16 wherein said ceramic cylinder is of beryllia.

23. A collector as claimed in claim 16 wherein rings of said first material are arranged alternately with rings of said second material along said axis.

24. A collector as claimed in claim 16 wherein adjacent rings are brazed together.

25. A collector as claimed in claim 16 wherein rings are brazed to said ceramic cylinder.

26. A collector as claimed in claim 16 and including an outer metal tube arranged coaxially outside and adjacent to said ceramic cylinder.

* * * * *